US007229229B2

(12) United States Patent
Wang

(10) Patent No.: US 7,229,229 B2
(45) Date of Patent: Jun. 12, 2007

(54) LIQUID DISPENSER

(75) Inventor: Teng-Huei Wang, Tainan Hsien (TW)

(73) Assignee: Yonyu Plastics Co. Ltd., Tainan (TW)

( * ) Notice: Subject to any disclaimer, the term of this patent is extended or adjusted under 35 U.S.C. 154(b) by 106 days.

(21) Appl. No.: 11/131,127

(22) Filed: May 17, 2005

(65) Prior Publication Data

US 2006/0263141 A1 Nov. 23, 2006

(51) Int. Cl.

| | |
|---|---|
| ***A46B 11/04*** | (2006.01) |
| ***A46B 17/04*** | (2006.01) |
| ***B05C 11/00*** | (2006.01) |
| ***A47L 13/30*** | (2006.01) |
| ***B43K 23/12*** | (2006.01) |

(52) U.S. Cl. ..... 401/280; 401/269; 401/272; 401/266; 401/263; 401/262

(58) Field of Classification Search ..... 401/269, 401/270, 272, 280, 262, 263, 202, 205, 213, 401/219, 243, 266

See application file for complete search history.

(56) References Cited

U.S. PATENT DOCUMENTS 5,213,431 A * 5/1993 Gentile et al. ..... 401/219
5,230,579 A * 7/1993 Klawson et al. ..... 401/205
6,854,914 B2 * 2/2005 Keating et al. ..... 401/270

* cited by examiner

*Primary Examiner*—David J. Walczak
(74) *Attorney, Agent, or Firm*—Frommer Lawrence & Haug LLP; Ronald R. Santucci

(57) ABSTRACT

A liquid dispenser includes a deformable container, a sealing unit and a brush unit. The container defines a liquid-storing space therein, and has a liquid-discharging opening for discharging a liquid contained in the liquid-storing space. The sealing unit is mounted movably on the container, defines a fluid channel, and is formed with a sealing member. The sealing unit is movable relative to the container between a closed position, in which the sealing member covers the liquid-discharging opening, and an opened position, in which the sealing member is spaced apart from the liquid-discharging opening. The brush unit is mounted on the sealing unit, includes a brush member, and defines a fluid passage in fluid communication with the liquid-discharging opening through the fluid channel when the sealing unit is disposed at the opened position.

7 Claims, 6 Drawing Sheets

LIQUID DISPENSER

BACKGROUND OF THE INVENTION

1. Field of the Invention

The present invention relates to a liquid dispenser, more particularly to a liquid dispenser with a brush unit.

2. Description of the Related Art

As shown in FIG. 1, a conventional liquid dispenser 1 includes a deformable container 11, a brush unit 12, and a brush cap 14.

The container 11 defines a liquid-storing space 110 therein, and has a liquid-discharging opening 116 for discharging a liquid contained in the liquid-storing space 110.

The container 11 includes a container body 111 that confines the liquid-storing space 110 and that has a discharging end, a ring-shaped wall 114 that is formed on the discharging end of the container body 111 and that defines the liquid-discharging opening 116, and an annular connecting wall 112 that extends from the ring-shaped wall 114 and that defines an accommodation space 115 therein. The liquid-storing space 110 is in fluid communication with the accommodation space 115 through the liquid-discharging opening 116.

The brush unit 12 includes a hollow mounting seat 13 that extends fittingly into the accommodation space 115, a hollow shank 121 mounted in and extending through the mounting seat 13 and defining a fluid passage 123, and a soft brush member 122 secured to the shank 121.

The brush cap 14 is threadedly engaged with the annular connecting wall 112.

When the conventional liquid dispenser 1 is in use, the brush cap 14 is removed from the container body 111 of the container 11. Then the container body 111 of the container 11 is squeezed to push the liquid contained in the liquid-storing space 110 to flow through the liquid-discharging opening 116 and the fluid passage 123 so as to wet the brush member 122 for applying the liquid to an object.

The conventional liquid dispenser is disadvantageous in that the liquid contained in the liquid-storing space 110 may flow through the liquid-discharging opening 116 and the fluid passage 123 upon accidental squeezing of the container body 111 when the same is not in use, i.e., with the brush cap 14 thereon, thereby undesirably causing wetting of the brush member 122. The brush member 122 may become stiff when the liquid is dried.

SUMMARY OF THE INVENTION

The object of the present invention is to provide a liquid dispenser that can overcome the aforesaid drawback associated with the prior art.

Accordingly, a liquid dispenser of the present invention comprises a deformable container, a sealing unit, and a brush unit.

The container defines a liquid-storing space therein, and has a liquid-discharging opening for discharging a liquid contained in the liquid-storing space.

The sealing unit is mounted movably on the container, defines a fluid channel, and is formed with a sealing member. The sealing unit is movable relative to the container between a closed position, in which the sealing member covers the liquid-discharging opening, and an opened position, in which the sealing member is spaced apart from the liquid-discharging opening.

The brush unit is mounted on the sealing unit, includes a brush member, and defines a fluid passage that is in fluid communication with the fluid channel so as to permit wetting of the brush member when the sealing unit is disposed at the opened position and when the container is squeezed to push the liquid contained in the liquid-storing space to flow through the liquid-discharging opening, the fluid channel and the fluid passage.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
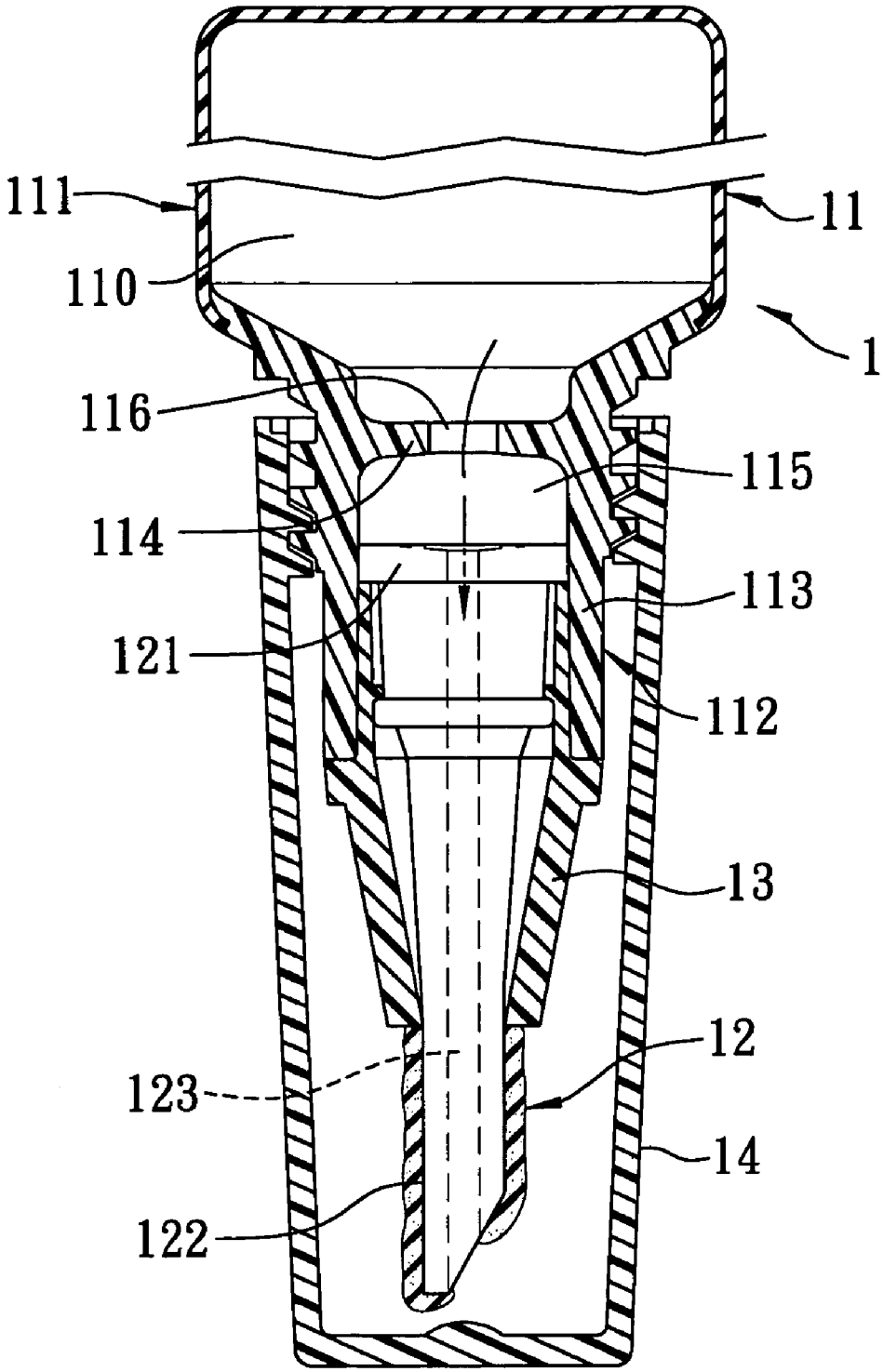
FIG. 1 PRIOR ART
FIG. 1 is an assembled perspective view of a conventional liquid dispenser.

Before the present invention is described in greater detail with reference to the accompanying preferred embodiments, it should be noted herein that like elements are denoted by the same reference numerals throughout the disclosure.

Figure 2:
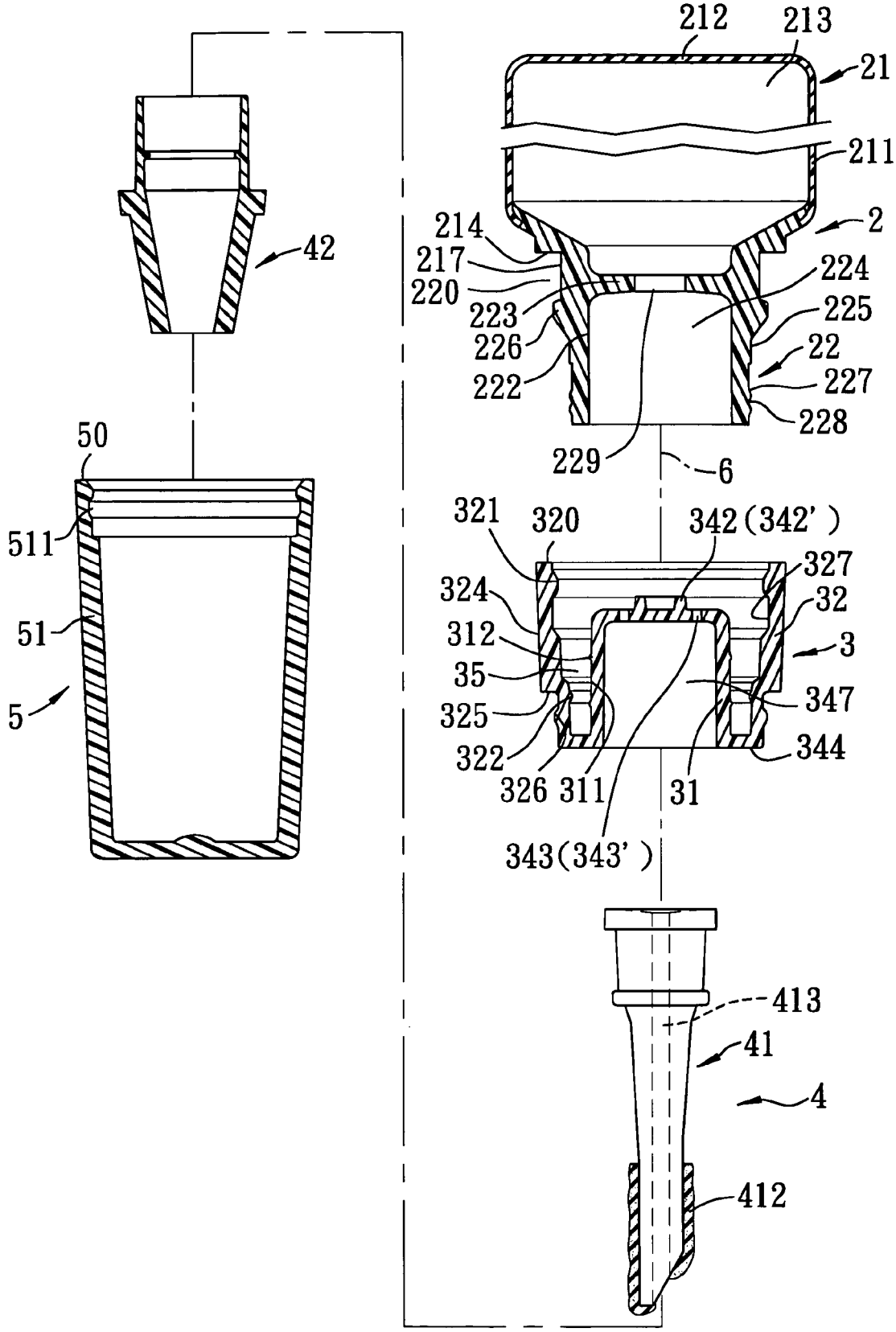
FIG. 2 is a fragmentary, exploded sectional view of the first preferred embodiment of a liquid dispenser according to the present invention.
Figure 3:
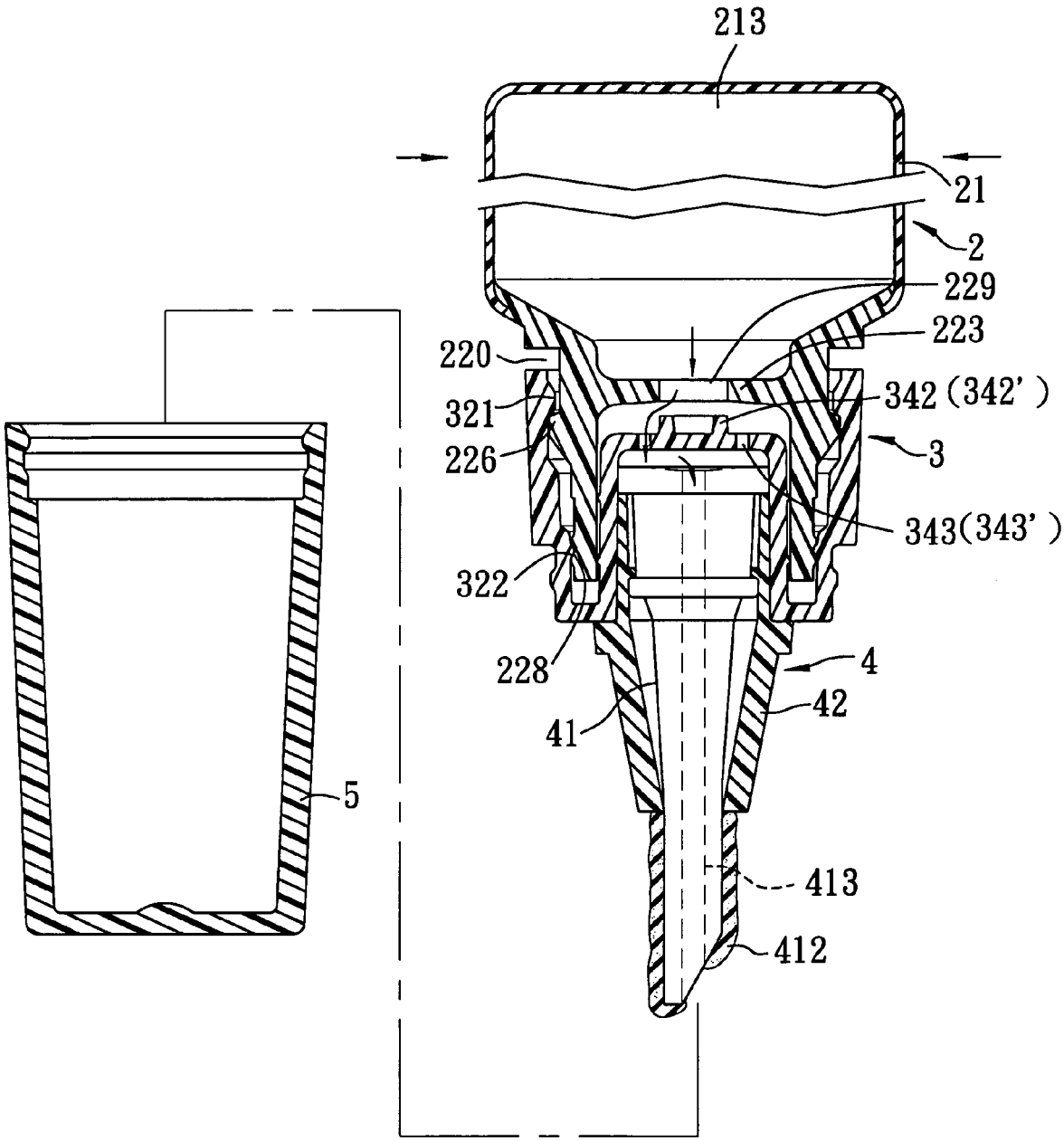
FIG. 3 is a fragmentary, partly exploded sectional view of the first preferred embodiment to illustrate an opened position of a sealing unit of the liquid dispenser.

Referring to FIGS. 2 and 3, the first preferred embodiment of a liquid dispenser according to the present invention is shown to include a deformable container 2, a sealing unit 3, a brush unit 4, and a brush cap 5.

The container 2 is made of a deformable plastic material, and includes a container body 21 defining a central axis 6, and an annular connecting wall 22 extending from the container body 21 and centered at the axis 6. The container body 21 includes a top wall 212 disposed transverse to the axis 6, and a surrounding wall 211 extending transversely from a periphery of the top wall 212 and cooperating with the top wall 212 to confine a liquid-storing space 213, and has a discharging end 217. The container 2 further includes a ring-shaped wall 223 that is formed on the discharging end 217 of the container body 21 and that defines a liquid-discharging opening 229. The annular connecting wall 22 extends from the ring-shaped wall 223, and defines an accommodation space 224 therein. The liquid-storing space 213 is in fluid communication with the accommodation space 224 through the liquid-discharging opening 229.

Figure 4:
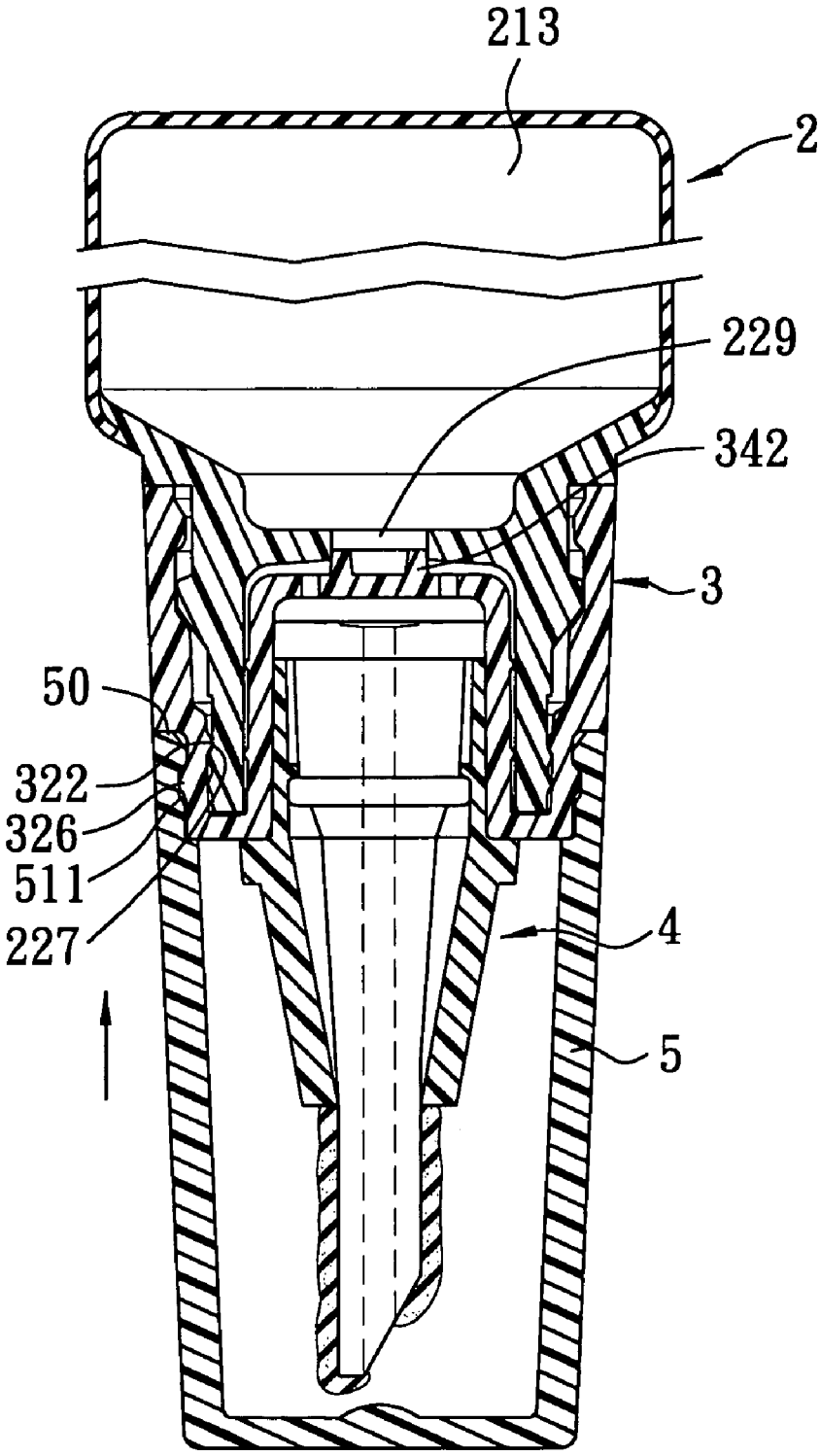
FIG. 4 is a fragmentary assembled sectional view of the first preferred embodiment to illustrate a closed position of the sealing unit of the liquid dispenser.

The sealing unit 3 is mounted movably on the container 2, and is movable relative to the container 2 between a closed position (see FIG. 4), in which the sealing unit 3 covers the liquid-discharging opening 229, and an opened position (see FIG. 3), in which the sealing unit 3 is spaced apart from the liquid-discharging opening 229.

The sealing unit 3 includes an inner inverted U-shaped wall 31 that defines a mounting space 347 and that is received in the accommodation space 224, and an annular outer wall 32 that is connected to and that surrounds the inverted U-shaped wall 31 and that cooperates with the inverted U-shaped wall 31 to define an annular receiving space 35 therebetween such that the annular connecting wall 22 of the container 2 is fittingly and movably received in the annular receiving space 35. The sealing unit 3 has a sealing member 342' formed with an annular protrusion 342 that protrudes outwardly from the inverted U-shaped wall 31, that extends into the liquid-discharging opening 229, that abuts against the ring-shaped wall 223 when the sealing unit 3 is disposed at the closed position, and that is disposed outwardly of the liquid-discharging opening 229 when the sealing unit 3 is disposed at the opened position. The inverted U-shaped wall 31 is formed with an annular hole 343' around the annular protrusion 342 and defining a fluid channel 343 of the sealing unit 3.

The annular connecting wall 22 of the container 2 includes an outer surface 225 formed with an annular upper groove 227 and an annular lower groove 228 disposed below the upper groove 227. The annular outer wall 32 of the sealing unit 3 has an inner surface 327 formed with a tongue 322 that engages releasably the upper groove 227 when the sealing unit 3 is disposed at the closed position, and that engages releasably the lower groove 228 when the sealing unit 3 is disposed at the opened position. As such, through engagement between the tongue 322 and a selected one of the upper and lower grooves 227, 228, the sealing unit 3 can be retained at a respective one of the closed and opened positions.

The container body 2 is formed with an annular neck 214. The connecting wall 22 is formed with an annular shoulder 226 that cooperates with the annular neck 214 to define a gap 220 therebetween. The annular outer wall 32 of the sealing unit 3 has an upper end face 320 and an annular rib 321 that is disposed adjacent to the upper end face 320 and that protrudes therefrom into the gap 220 between the neck 214 and the shoulder 226. The upper end face 320 of the annular outer wall 32 abuts against the neck 214 when the sealing unit 3 is disposed at the closed position.

The connecting wall 22 of the container 2 has an inner surface 222. The inverted U-shaped wall 31 has an outer surface 311 that is formed with at least an annular protrusion 312 abutting slidingly against the inner surface 222 of the connecting wall 22 for providing a suitable friction therebetween, and for preventing leakage of liquid therethrough. In this embodiment, two annular protrusions 312 are formed.

The brush unit 4 includes a hollow mounting seat 42 that extends fittingly into the mounting space 347 in the inverted U-shaped wall 31, and a hollow shank 41 mounted in and extending through the mounting seat 42 and defining a fluid passage 413 of the brush unit 4, and a brush member 412 secured to the shank 41.

The brush cap 5 engages removably an outer surface 324 of the annular outer wall 32 of the sealing unit 3 in a tongue-and-groove manner for covering the brush unit 4. In this embodiment, the annular outer wall 32 has a bottom end face 344. The outer surface 324 of the annular outer wall 32 is formed with an annular neck 325, and a tongue 326 disposed between the bottom end face 344 and the annular neck 325. The brush cap 5 has an upper end face 50 that abuts against the annular neck 325 when fully engaged with the sealing unit 3, and an inner surface 51 formed with a groove 511 disposed below the upper end face 50 for engaging the tongue 326 of the annular outer wall 32 of the sealing unit 3.

When the liquid dispenser is in use, as shown in FIG. 3, the brush cap 5 is removed from the sealing unit 3, and the sealing unit 3 is subsequently moved to the opened position so that the sealing member 342' is spaced apart from the liquid-storing space 213, and the tongue 322 of the sealing unit 3 engages the lower groove 228. Then, when the container body 21 of the container 2 is squeezed, the liquid contained in the liquid-storing space 213 of the container 2 is pushed to flow through the liquid-discharging opening 229, the accommodation space 224, and the fluid channel 343 into the fluid passage 413 so as to wet the brush member 412 for application of the liquid.

Figure 5:
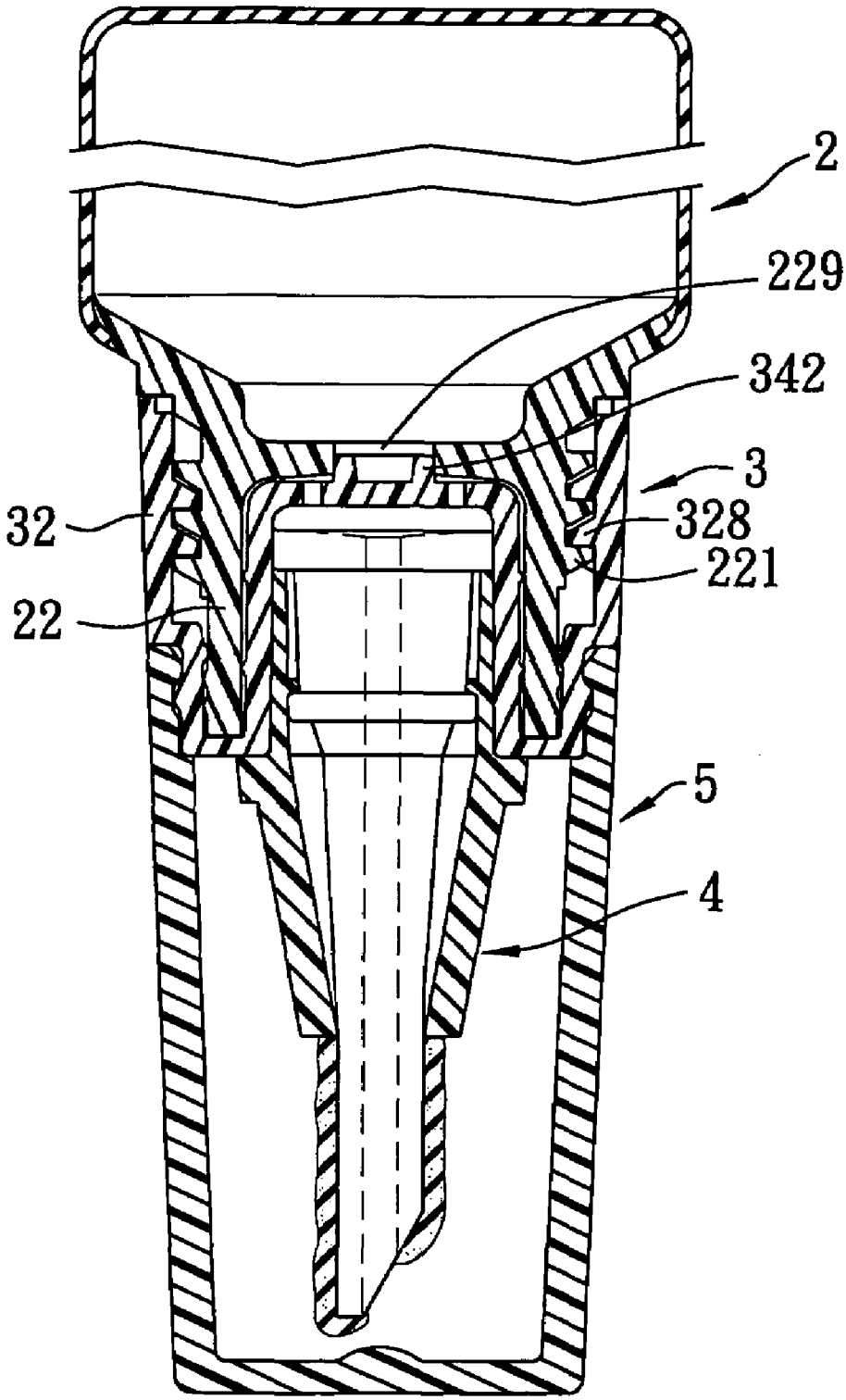
FIG. 5 is a fragmentary assembled sectional view of the second preferred embodiment of a liquid dispenser according to the present invention, illustrating a closed position of a sealing unit of the liquid dispenser.
Figure 6:
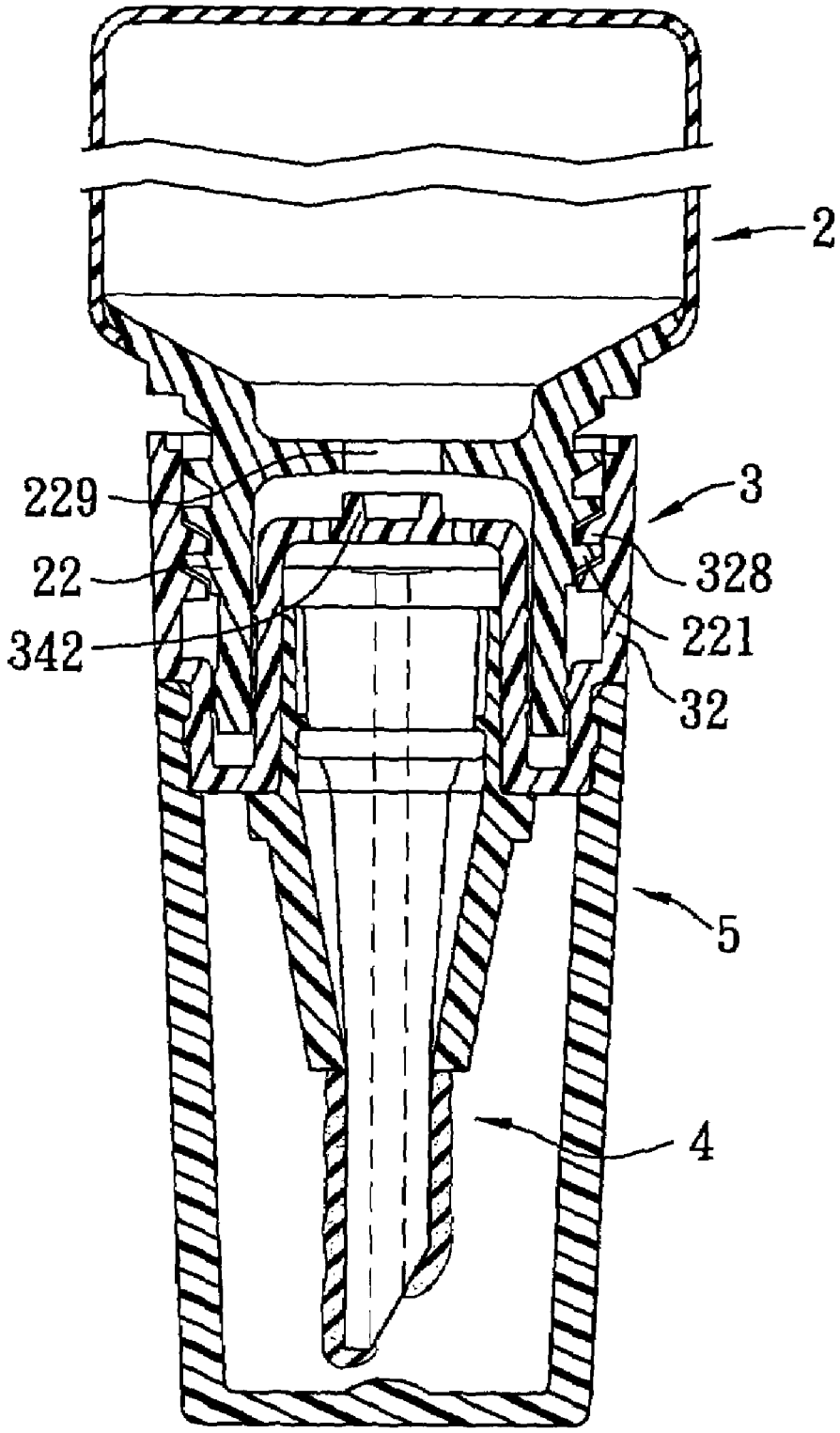
FIG. 6 is a fragmentary assembled sectional view of the second preferred embodiment to illustrate an opened position of the sealing unit of the liquid dispenser.

Referring to FIGS. 5 and 6, the second preferred embodiment of a liquid dispenser according to this invention is shown to have a structure similar to that of the first preferred embodiment, except that: the annular connecting wall 22 of the container 2 has an outer thread 221, and that the annular outer wall 32 of the sealing unit 3 has an inner thread 328 that threadedly engages the outer thread 221. When the sealing unit 3 of the liquid dispenser is to be moved from the closed position as shown in FIG. 5 to the opened position as shown in FIG. 6, the container 2 is held still by one hand, and the sealing unit 3 together with the brush cap 5 is rotated relative to the container 2 by the other hand until the sealing member 342' is spaced apart from the liquid-discharging opening 229.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A liquid dispenser comprising:

a deformable container defining a liquid-storing space therein and having a liquid-discharging opening for discharging a liquid contained in said liquid-storing space;

a sealing unit mounted movably on said container, defining a fluid channel, and formed with a sealing member, said sealing unit being movable relative to said container between a closed position, in which said sealing member covers said liquid-discharging opening, and an opened position, in which said sealing member is spaced apart from said liquid-discharging opening;

a brush unit mounted on said sealing unit, including a brush member, and defining a fluid passage that is in fluid communication with said fluid channel so as to permit wetting of said brush member when said sealing unit is disposed at said opened position and when said container is squeezed to push the liquid contained in said liquid-storing space to flow through said liquid-discharging opening, said fluid channel and said fluid passage; and a brush cap;

said container includes a container body that confines said liquid-storing space and that has a discharging end, a ring-shaped wall that is formed on said discharging end of said container body and that defines said liquid-discharging opening, and an annular connecting wall that extends from said ring-shaped wall and that defines an accommodation space therein, said liquid-storing space being in fluid communication with said accommodation space through said liquid-discharging opening;

said sealing unit includes an inverted U-shaped wall that is received in said accommodation space, and an annular outer wall that is connected to and that surrounds said inverted U-shaped wall and that cooperates with said inverted U-shaped wall to define an annular receiving space therebetween, said annular connecting wall of said container being fittingly and movably received in said annular receiving space, said sealing member having an annular protrusion that protrudes outwardly from said inverted U-shaped wall, said annular protrusion extending into said liquid-discharging opening and abutting against said ring-shaped wall when said sealing unit is disposed at said closed position, and being disposed outwardly of said liquid-discharging opening when said sealing unit is disposed at said opened position; and wherein said brush cap engages removably said annular outer wall of said sealing unit in a tongue-and-groove manner for covering said brush unit.

2. The liquid dispenser as claimed in claim 1, wherein said inverted U-shaped wall is formed with an annular hole around said annular protrusion, said annular hole defining said fluid channel of said sealing unit.

3. The liquid dispenser as claimed in claim 2, wherein said inverted U-shaped wall defines a mounting space therein, said brush unit further including a hollow mounting seat that extends fittingly into said mounting space in said inverted U-shaped wall, and a hollow shank mounted in and extending through said mounting seat and defining said fluid passage of said brush unit, said brush member being secured to said shank.

4. The liquid dispenser as claimed in claim 1, wherein said annular connecting wall of said container has an outer surface formed with an annular upper groove and an annular lower groove disposed below said upper groove, said annular outer wall of said sealing unit having an inner surface formed with an annular tongue that engages releasably said upper groove when said sealing unit is disposed at said closed position, and that engages releasably said lower groove when said sealing unit is disposed at said opened position.

5. The liquid dispenser as claimed in claim 1, wherein said annular connecting wall of said container has an inner surface, said inverted U-shaped wall having an outer surface that is formed with at least an annular protrusion abutting against said inner surface of said connecting wall.

6. The liquid dispenser as claimed in claim 1, wherein said container body is formed with an annular neck, said annular connecting wall is formed with an annular shoulder that cooperates with said annular neck to define a gap therebetween, said annular outer wall of said sealing unit having an upper end face and an annular rib that is disposed adjacent to said upper end face and that protrudes therefrom into said gap between said neck and said shoulder, said upper end face of said annular outer wall abutting against said neck when said sealing unit is disposed at said closed position, said rib abutting against said shoulder when said sealing unit is disposed at said opened position.

7. The liquid dispenser as claimed in claim 1, wherein said annular connecting wall of said container is formed with an outer thread, said annular outer wall of said sealing unit being formed with an inner thread that engages threadedly said outer thread.

* * * * *